US006244359B1

(12) United States Patent
Bridges et al.

(10) Patent No.: US 6,244,359 B1
(45) Date of Patent: Jun. 12, 2001

(54) SUBSEA DIVERTER AND ROTATING DRILLING HEAD

(75) Inventors: Charles D. Bridges, Cypress; Glen H. Cuiper, Spring; L. Steven Landriault; Noel A. Monjure, both of Houston, all of TX (US)

(73) Assignee: ABB Vetco Gray, Inc., Houston, TX (US)

( * ) Notice: Subject to any disclaimer, the term of this patent is extended or adjusted under 35 U.S.C. 154(b) by 0 days.

(21) Appl. No.: 09/286,710

(22) Filed: Apr. 5, 1999

Related U.S. Application Data

(60) Provisional application No. 60/080,863, filed on Apr. 6, 1998.

(51) Int. Cl.[7] ..... E21B 7/128

(52) U.S. Cl. ..... 175/5; 175/65; 166/358; 166/363; 166/368; 166/86.2; 251/1.2; 384/97

(58) Field of Search ..... 166/358, 351, 166/363, 364, 368, 340, 86.2; 175/5, 65; 251/1.2; 384/97, 93, 98

(56) References Cited

U.S. PATENT DOCUMENTS

| | | | | |
|---|---|---|---|---|
| 2,124,395 | | 7/1938 | Caughey | 415/175 |
| 3,044,481 | | 7/1962 | Regan | 137/114 |
| 3,251,611 | * | 5/1966 | Haeber et al. | 166/338 |
| 3,315,742 | * | 4/1967 | Nicholson | 166/338 |
| 3,492,007 | | 1/1970 | Jones | 277/325 |
| 3,587,734 | * | 6/1971 | Shaffer | 166/368 |
| 3,601,188 | * | 8/1971 | McGlamery | 166/351 |
| 3,621,912 | * | 11/1971 | Wooddy et al. | 166/340 |
| 3,638,721 | | 2/1972 | Harrison | 166/351 |
| 3,788,396 | * | 1/1974 | Shatto, Jr. et al. | 166/341 |
| 3,800,869 | * | 4/1974 | Herd et al. | 166/337 |
| 3,825,065 | * | 7/1974 | Lloyd et al. | 166/351 |
| 4,098,341 | | 7/1978 | Lewis | 166/387 |
| 4,378,849 | | 4/1983 | Wilks | 166/369 |
| 4,383,577 | | 5/1983 | Pruitt | 166/95.1 |
| 4,478,287 | * | 10/1984 | Hynes et al. | 166/341 |
| 4,618,314 | | 10/1986 | Hailey | 417/53 |
| 4,813,495 | * | 3/1989 | Leach | 175/6 |
| 5,022,472 | | 6/1991 | Bailey et al. | 175/195 |
| 5,178,215 | | 1/1993 | Yenulis et al. | 166/95.1 |
| 5,224,557 | | 7/1993 | Yenulis et al. | 175/195 |
| 5,277,249 | | 1/1994 | Yenulis et al. | 166/84.3 |
| 5,279,365 | | 1/1994 | Yenulis et al. | 166/84.3 |
| 5,372,201 | | 12/1994 | Yenulis et al. | 166/382 |
| 6,016,880 | | 1/2000 | Hall et al. . | |

FOREIGN PATENT DOCUMENTS

0290250A2 9/1988 (EP) .

* cited by examiner

*Primary Examiner*—David Bagnell
*Assistant Examiner*—John Kreck
(74) *Attorney, Agent, or Firm*—James E. Bradley; Bracewell & Patteron, L.L.P.

(57) ABSTRACT

A drilling head used to seal around a drill pipe while drilling is employed in a subsea location. The drilling head has an inner body located within an outer body. At least one bearing is located between the outer body and the inner body for facilitating the rotation of the inner body relative to the outer body. A seal mounted to a lower portion of the inner body seals around the outer surface of the drill pipe. While lowering the drilling head to the wellhead, a support attached to the drill pipe is inserted into a skirt which surrounds a portion of the seal. The skirt and support are releasably connected using a J-slot mechanism. An inner annulus and an outer annulus are located between the inner and outer bodies, the annuluses containing a lubricating fluid. Helical vanes are located within the inner annulus and affixed to the inner body. The vanes rotate with the inner body for circulating the fluid through the inner and outer annuluses. A set of fins are attached to the outer body for enhancing the heat transfer from the fluid and through the outer body to the exterior environment.

11 Claims, 7 Drawing Sheets

SUBSEA DIVERTER AND ROTATING DRILLING HEAD

CROSS-REFERENCE TO RELATED APPLICATIONS

This application claims the benefit of provisional application, U.S. Ser. No. 60/080,863, filed Apr. 6, 1998.

TECHNICAL FIELD

This invention relates in general to rotating drilling heads and in particular to a subsea rotating drilling head that seals against drill pipe during drilling.

BACKGROUND OF THE INVENTION

In a subsea well of the type concerned herein, a wellhead housing locates on the sea floor. Strings of casing extend into the well, with the casings being supported in the wellhead housing. A casing hanger seal is installed between the casing hanger at the upper end of the casing and the wall of the wellhead housing. The operator installs the casing and the seal remotely and sometimes in seas of considerable depths.

There have been a number of types of running tools used and proposed in the patented art. With the advent of metal-to-metal casing hanger seals, the forces required to set these seals are greater than the prior art elastomeric seals. Running tools have to be capable of delivering very large forces. One type utilizes hydraulic pressure, as shown in U.S. Pat. Nos. 4,969,516 and 4,928,769. The hydraulic pressure is generated by axial movement of the drill string, which moves a piston within a sealed hydraulic chamber in the running tool. These hydraulic tools work well. However, they are complex and expensive.

U.S. Pat. No. 5,044,442 shows a type that is hydraulically actuated, but uses annulus pressure. Rams are closed around the drill string, creating a chamber located above the wellhead housing within the riser. A bulk seal seals a portion of the running tool to the wellhead housing above the setting sleeve and casing hanger seal. The bulk seal enables pressure to be applied to a piston of the running tool. Fluid is pumped down a choke and kill line to this chamber, which actuates the piston within the running tool to set the casing hanger seal. The annulus pressure actuated hydraulic tool described in that patent is feasible, however a possibility exists that the bulk seal could seal on the wellhead housing at a point above the desired position. If so, the casing hanger seal might be actuated before it is located fully within the pocket between the casing hanger and the bore of the wellhead housing.

Subsea drilling is a problem in certain areas, such as the Gulf of Mexico. Shallow formations in the Gulf of Mexico present special problems that must be solved with a variety of techniques, which include using extra casing strings, etc. Another solution proposed is drilling with positive pressure. This may require the use of a rotating drilling head, seals and drill pipe. The prior art only used this equipment for horizontal or underbalanced wells at the surface, not subsea.

SUMMARY OF THE INVENTION

An improved system to provide control of mud, aquifer and cement flows experienced during installation of subsea conductor strings is provided. The shallow water flow diverter system of the subsea diverter and rotating drilling head of the invention is for providing a controlled system for mud, cuttings and cement that are produced during the installation of subsea wellhead conductors and isolating the pressure effect created by water depth. The system of the invention has provisions to contain and minimize any shallow water flows that may be encountered and provides the ability to shut off any undesired aquifer flows. Additionally, the system provides the capability of minimizing any flows that are the cause of instability in unconsolidated formations.

The invention includes a diverter housing assembly that consists of an upper housing that is flanged to a lower latch assembly. The upper housing provides a landing shoulder and locking mechanism for a shallow water flow diverter. The locking mechanism consists of a series of dog segments that are stroked radially inward and engage a profile on the diverter insert. The lock and unlock functions for the insert are located on the diverter control panel that is mounted on the diverter housing assembly. An alignment funnel has been incorporated into the top of the diverter housing assembly to guide the shallow water flow diverter insert during installation. In addition, the diverter housing assembly incorporates a choke to channel drilling cuttings and a relief valve that is designed to vent should an overpressure condition occur within the diverter housing assembly. Because the diverter housing assembly is flanged to the lower latch assembly, it can be easily adapted to lower latch assemblies manufactured by other suppliers.

The lower latch assembly consists of a series of locking dogs that mate with a mandrel profile on the 38" conductor housing. The locking dogs are hydraulically actuated through an ROV hot stab located on the diverter control panel. The lower latch assembly also includes an ROV operated mechanical override to unlatch the locking dogs from the conductor in the event of a hydraulic failure.

The rotating diverter head insert lands and locks into the housing to provide a dynamic seal on the drill pipe during drilling operations. The sealing system incorporates two dynamic seals, the stripper rubber seal and the gripper seal. The stripper rubber seal is a passive elastomer seal that resides on the lower portion of the drilling head insert and forms the primary sealing barrier. The gripper seal is a hydraulically energized element seal that forms the secondary sealing barrier on the drill pipe and grips the drill string. Hydraulic pressure from the diverter control system compresses the gripper seal assembly around the drill pipe. As the drill pipe turns, the gripper seal transmits torque from the drill string to the rotating diverter head insert so it will rotate along with the drill pipe. Heavy-duty bearings are used above and below the gripper seal assembly to facilitate this rotation. The drilling head insert is run along with the drill pipe using a running tool.

BEST MODE FOR CARRYING OUT THE INVENTION

Figure 1:
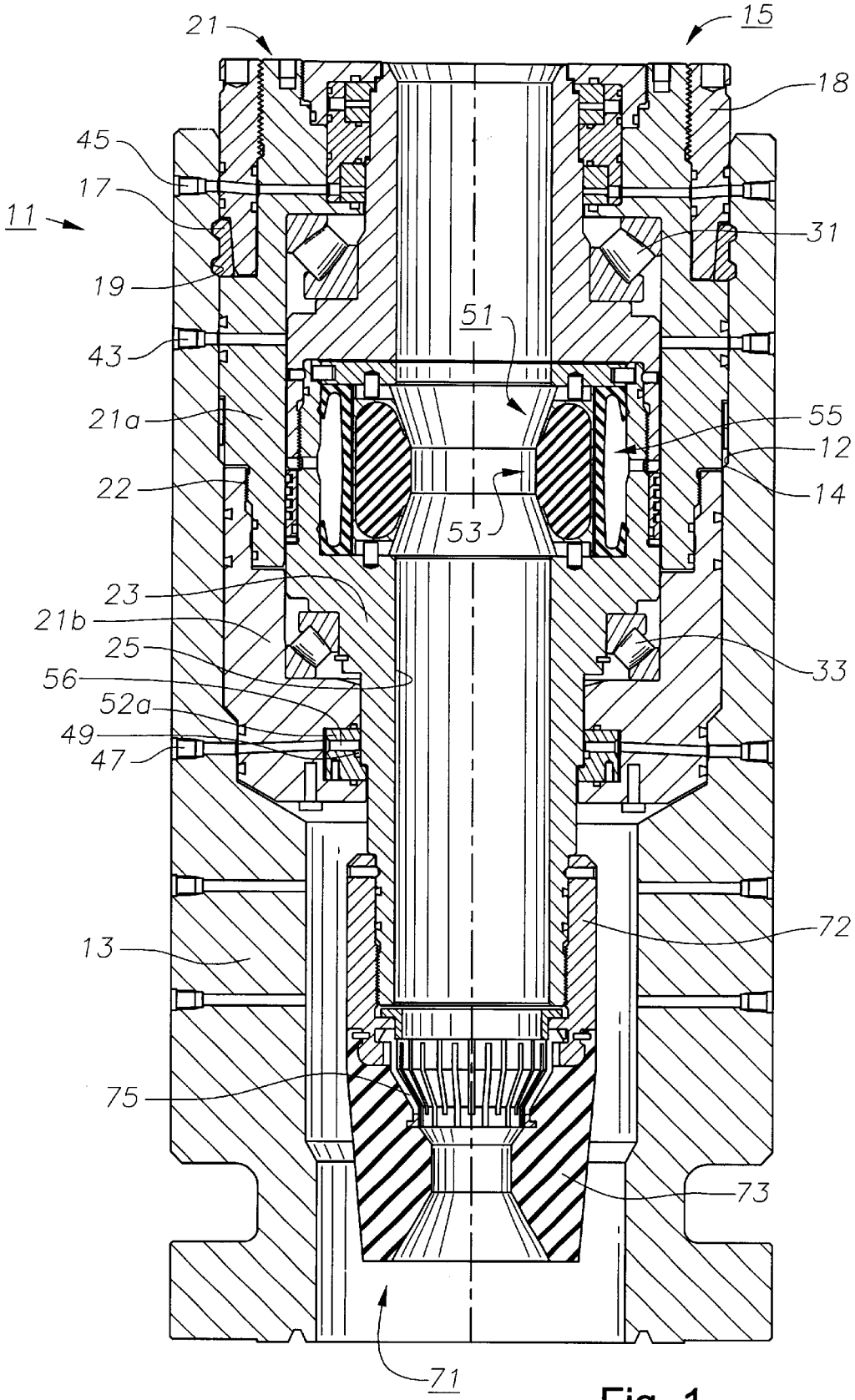
FIG. 1 is a sectional side view of a drilling head constructed in accordance with the invention.

Referring to FIG. 1, a cylindrical drilling head 11 is used in conjunction with drill pipe (not shown) having a plurality of tool joints. The tool joints are the threaded connector portions of each section of pipe and have enlarged outer diameters over the remaining portion of the pipe. Drilling head 11 has a body assembly 15 with a lower shoulder 12 that lands on an upward facing shoulder 14 in an external housing 13. In one embodiment, body assembly 15 is removably secured to housing 13 with an annular split ring or locking member 17. Body assembly 15 may also be secured to housing 13 with a breech lock (not shown). When a cam member 18 is rotated downward relative to body assembly 15, locking member 17 is forced radially outward and seats in a groove 19 in housing 13 to lock body assembly 15 from upward movement.

Body assembly 15 comprises an outer body 21 having an upper portion 21*a* and a lower portion 21*b* which are secured to one another at threads 22. Body assembly 15 also has a rotor or inner body 23 with an axial bore 25. Inner body 23 is rotatable relative to stationary outer body 21 on upper bearings 31 and lower bearings 33. In the preferred embodiment, bearings 31, 33 are tapered spherical roller bearings.

Figure 2:
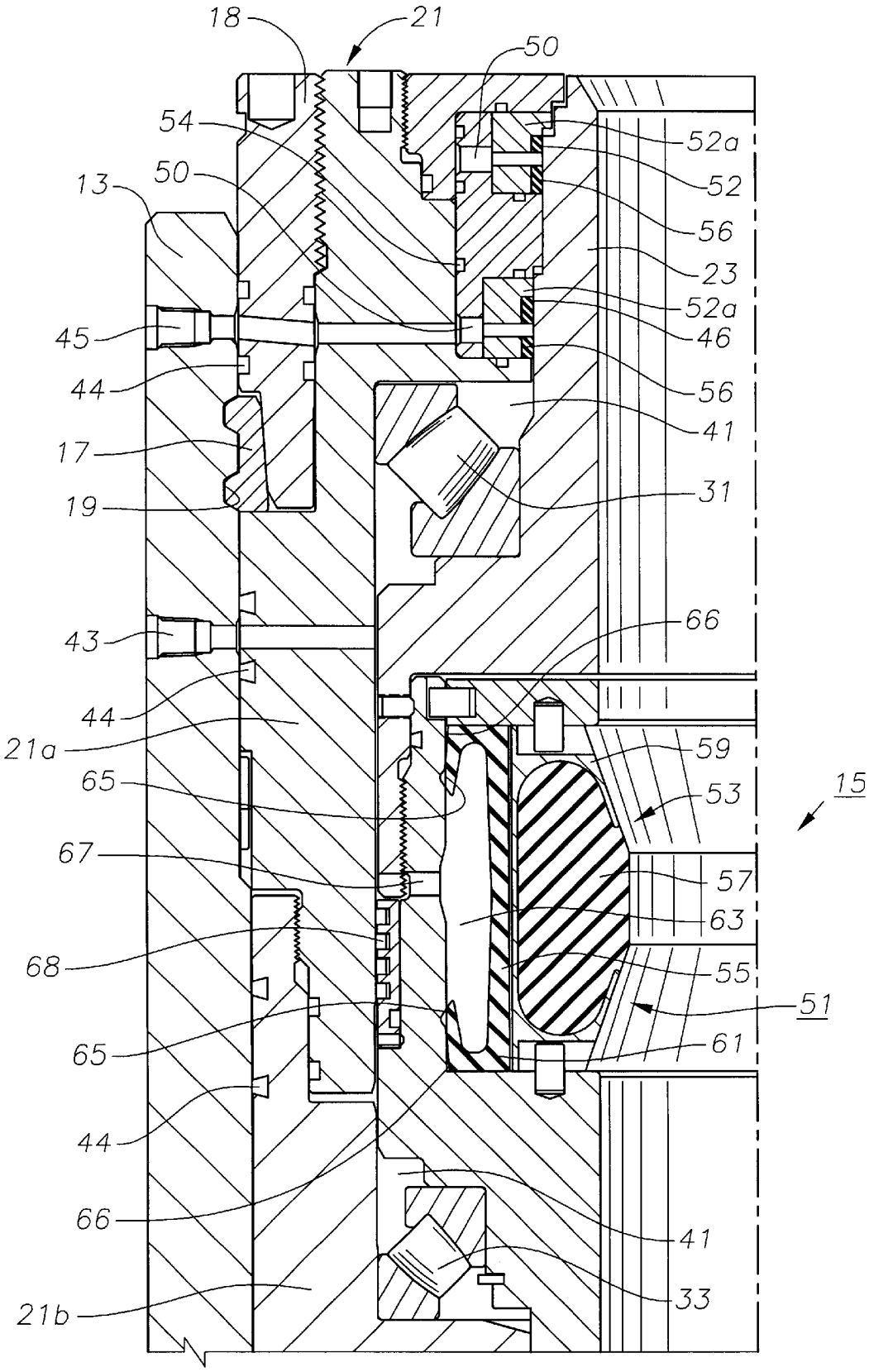
FIG. 2 is an enlarged, left sectional side view of an upper portion of the drilling head of FIG. 1.

As shown in FIG. 2, an annulus 41 extends between outer body 21 and an upper portion of inner body 23. An inlet port 43 and two outlet ports 45, 47 (FIG. 1) communicate hydraulic fluid or lubricant with annulus 41. Seals 44 seal ports 43, 45 between housing 13, cam member 18 and outer body 21. Annulus 41 is sealed on an upper side by seals 46, 52 and on a lower side by seal 49 (FIG. 1). Seals 46, 52 and 49 slidingly engage inner body 23 and are each supported by a seal holder 52*a*. A bronze bushing 56 is located between each seal holder 52*a* and inner body 23. Bushings 56 are provided as sacrificial wear elements to prevent erosion to seals 46, 52 and 49 and seal holders 52*a* as rotor body 23 slides laterally within outer body 21, and to transmit the lateral motion from rotor body 23 to seal holders 52*a*. In the preferred embodiment (not shown), seals 46, 52 and 49 comprise seals as described in U.S. Pat. No. 4,484,753 to Kalsi. Each seal 46, 52 handles one half of the hydraulic fluid pressure at the upper end of drilling head 11. Seal 46 reduces the pressure by 50 percent, while seal 52 absorbs the residual pressure to prevent the leakage at the upper end of annulus 41. Seals 46, 52 also have parallel passages 50 that communicate with port 45 for flowing lubricating fluid through the seal. Seals 46, 52 and 49 also have seals 54 for preventing drilling mud from contacting bearings 31, 33.

Inner body 23 has a centrally located packer or gripping member 51 with an inner portion 53 and an outer portion 55. Inner portion 53 comprises a solid annular elastomer 57 that is supported by rigid segments 59. Segments 59 have radially inward facing, C-shaped cross-sections. Inner portion 53 is free to slide radially relative to inner body 23. Elastomer 57 defines the smallest inner diameter of gripping member 51. In an unenergized state, the inner diameter of elastomer 57 is greater than the diameter of the drill pipe but slightly smaller than the diameter of the pipe joints. In an energized state, the inner diameter of elastomer 57 is smaller than the diameter of the drill pipe. The outer diameter of inner portion 53 abuts the inner diameter of outer portion 55. Outer portion 55 comprises a channel or annular elastomer 61 having a radially outward facing, C-shaped cross-section and with an annular cavity 63. Elastomer 61 has a pair of lips 65 that protrude toward one another. Cavity 63 communicates with annulus 41 through a passage 67. Drill head 11 contains an optional labyrinth seal 68 between inner body 23 and outer body upper portion 21*a*. Labyrinth seal 68 is provided for limiting or restricting flow of the lubricant toward lower bearings 33. Because of the close clearance between outer body 21*a* and inner body 23 and/or labyrinth seal 68, the lubricant pressure around lower bearings 33 will be less than that around upper bearings 31. As a result, the lubricant circulating through annulus 41 exerts a downward force on inner body 23 that will partially offset the upward force exerted on inner body 23 by well bore fluid.

Figure 3:
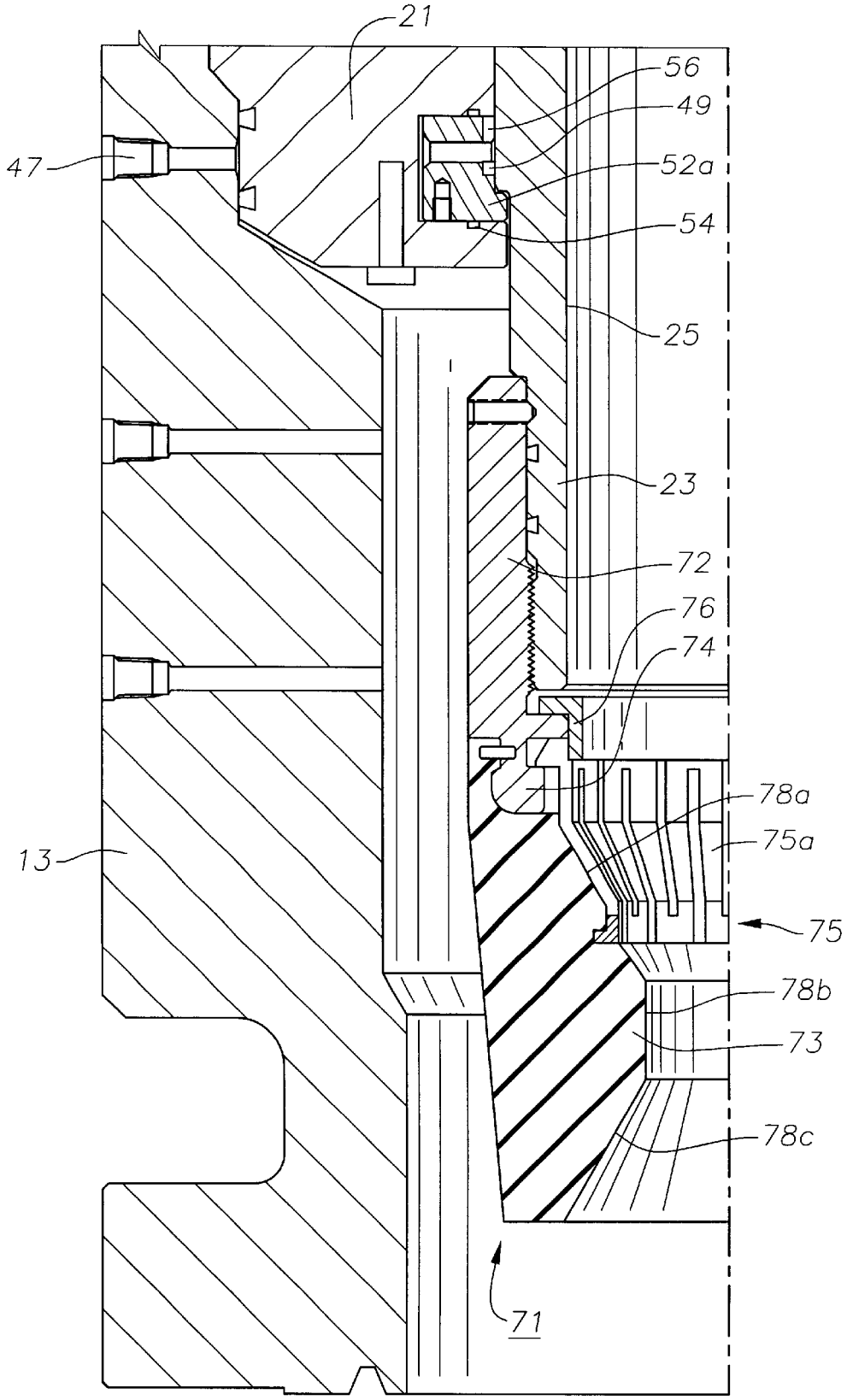
FIG. 3 is an enlarged, left sectional side view of a lower portion of the drilling head of FIG. 1.

Referring now to FIG. 3, a primary seal 71 extends from a lower end of inner body 23 and is spaced axially apart from gripping member 51. Seal 71 has a tubular member 72 that threadingly engages an outer portion of inner body 23. Seal 71 also comprises an elastomer 73 which has a frustoconical exterior and a tapered metal ring 75 along an inner surface. Ring 75 is slit from a lower end. Ring 75 has conically-arrayed reinforcement webs 75*a* that reinforce elastomer 73. The upper end of ring 75 is rigidly fastened to a flange 74 on the lower end of tubular member 72 with a lock ring 76. The lower end of ring 75 mechanically engages an inner portion of elastomer 73. Elastomer 73 is molded around flange 74 and ring 75 to give elastomer 73 greater rigidity against inward-directed forces. The slit in ring 75 allows the individual webs 75*a* to flex radially outward with elastomer 73 in a hinge-like fashion. Elastomer 73 has an axial passage with an upper conical portion 78*a*, a central cylindrical portion 78*b*, and a lower conical portion 78*c*. The internal diameter of central cylindrical portion 78*b* is smaller than the diameter of bore 25, gripping member 51, and the outer diameter of the drill pipe. Seal 71 provides the primary seal for sealing drilling head 11 against the drill pipe. Gripping member 51 causes seal 71 to rotate with the drill pipe and provides an auxiliary or secondary seal for sealing drilling head 11 against the drill pipe.

In operation, a string of drill pipe is lowered through bore 25 of drill head 11 (not shown). Bore 25 is large enough to permit the enlarged diameter of the tool joints to pass through. When tool joints are lowered through seal 71, elastomer 73 and ribs 75 flex radially outward as the tool joint passes through seal 71. As the tool joint exits seal 71, seal 71 contracts back to its original shape with central portion 78*b* sealing around the drill pipe.

During drilling, gripping member 51 is energized to grip and provide a secondary seal around the drill pipe, thereby causing body 23 to rotate with the drill pipe. This is done by pumping hydraulic fluid through inlet port 43. As the hydraulic fluid circulates through annulus 41 and out outlet ports 45, 47, bearings 31, 33, upper seal 46 and lower seal 49 are simultaneously lubricated by the hydraulic fluid. The hydraulic fluid also enters cavity 63 through passage 67. This pressure energizes gripping member 51 by pressing radially inward against outer portion 55, which exerts pressure against inner portion 53. Due to labyrinth seal 68, the pressure in the upper portion of annulus 41 is higher than the pressure in the lower portion of annulus 41. As a result, the upward force applied to inner body 23 by the well fluid pressure is at least partially counteracted by a downward force exerted on inner body 23 by the hydraulic fluid.

Figure 4:
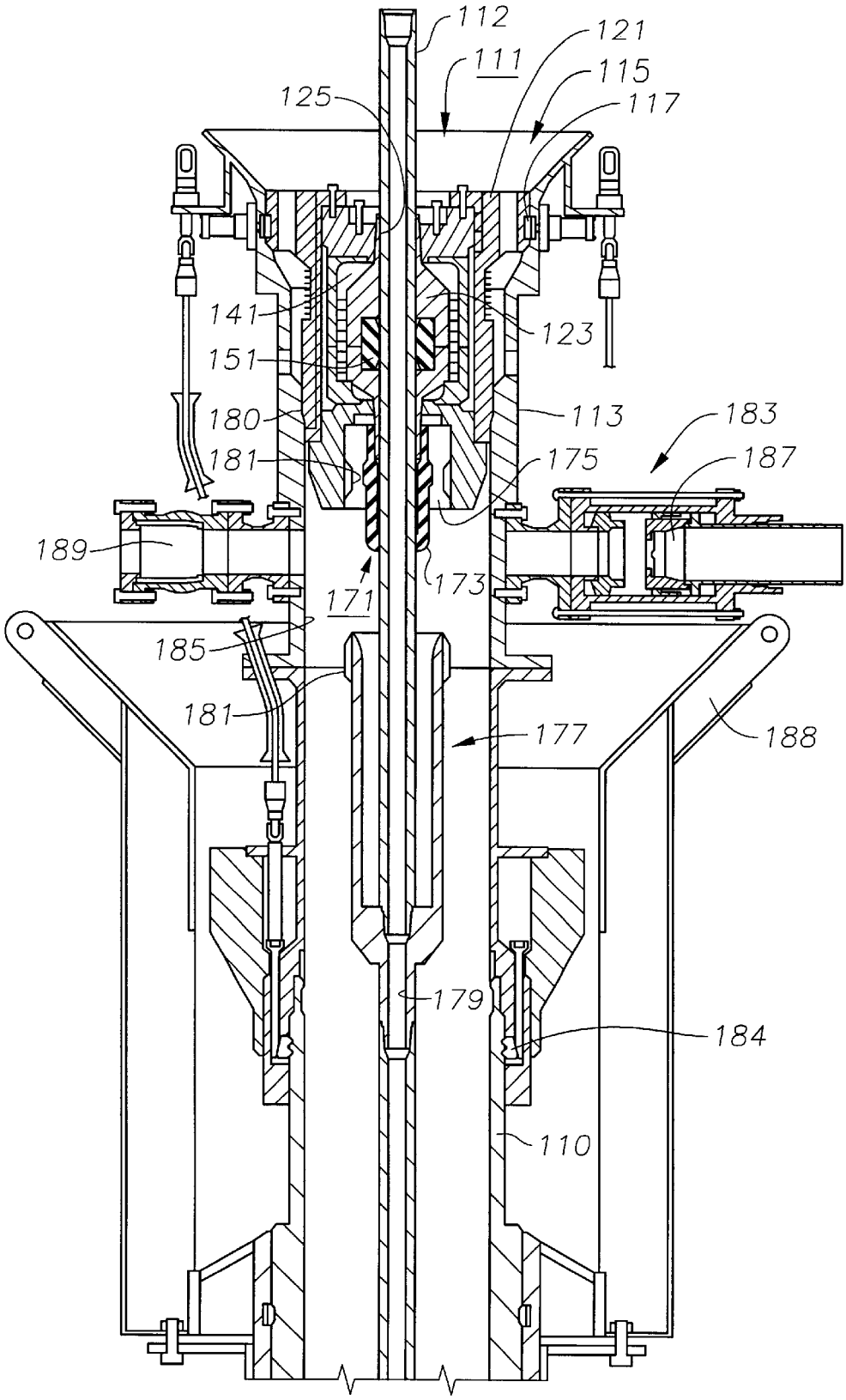
FIG. 4 is a sectional side view of a drilling head constructed in accordance with the invention, shown located on a subsea wellhead, and with a drill string mandrel spaced below.

Referring to FIG. 4, drilling head 111 is designed to be easily tripped into and out of engagement with the wellhead during subsea use. Drilling head 111 is used in conjunction with drill pipe 112. Drilling head 111 has a body 115 that lands in a tubular diverter housing 113. Body 115 is removably secured to diverter housing 113 with hydraulically-actuated dogs 117 at an upper end. Dogs 117 are forced radially inward and seat in an external profile on body 115 to lock drilling head 111 from upward movement.

Figure 5:
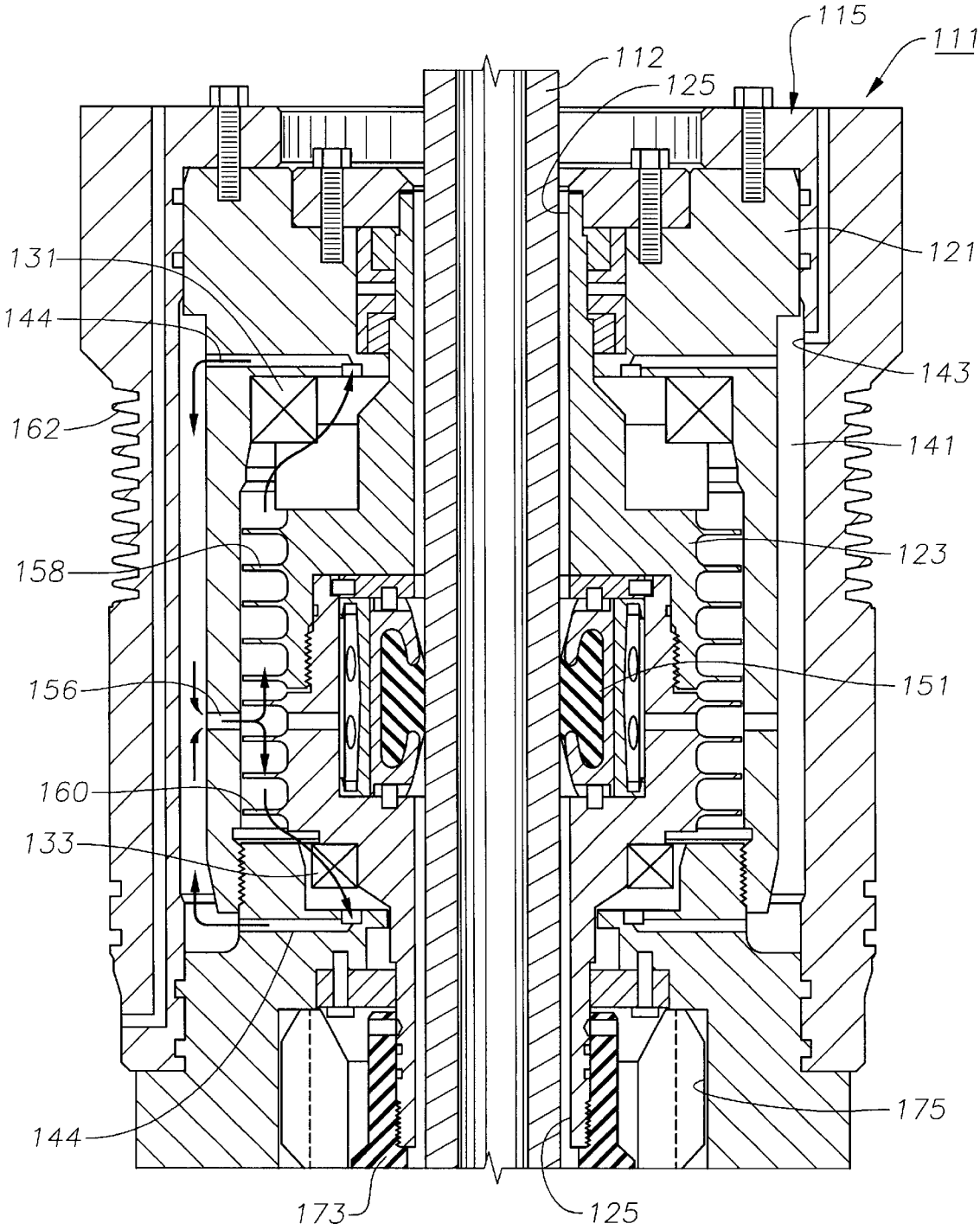
FIG. 5 is an enlarged sectional view of the drilling head of FIG. 4, with the housing not being shown.

Referring to FIG. 5, body 115 is formed of several components, including an outer body 121 and an inner body 123. Inner body 123 is located within outer body 121 and has an axial bore 125. Inner body 123 is rotatable relative to inner body 121 on bearings 131, 133. An annular hydraulic fluid reservoir 141 is located between two portions of outer body 121. An inlet port 143 leading from an exterior fluid supply is used to fill annulus 141 with hydraulic fluid. Fluid is circulated from annulus 141 though outlet ports 156, through spaces between inner body 123 and outer body 121, and through bearings 131, 133. Upper and lower circulation ports 144 return fluid back to annulus 141. The circulation is caused by upper and lower helical vanes 158, 160. Upper helical vane 158 extends in one direction and is mounted to the exterior sidewall of inner body 123 for rotation therewith. Lower helical vane 160 is mounted to the exterior of inner body 123 and extends in the opposite direction. Vanes 158 and 160 join each other at outlet ports 156. As shown by the arrows, rotation of inner body 123 causes fluid to circulate upward through bearings 131 and downward through bearings 133. The fluid returns to annulus 141 through circulation ports 144. Fins 162 may be located on the exterior of outer body 121 for enhanced cooling.

Drilling head 111 utilizes a number of seals to seal between these components. Inner body 123 has a centrally located packer or gripping member 151 which when engaged, grips drill pipe 12. Referring to FIG. 4, drilling head 111 also has a primary seal 171 on a lower end. Seal 171 has a reinforced elastomer 173. Elastomer 173 has an axial passage with a diameter which is smaller than the outer diameter of drill pipe 112. Seal 171 provides the primary seal for sealing drilling head 111 against drill pipe 112. Gripping member 151 causes seal 171 to rotate with the drill pipe and provides an auxiliary or secondary seal for sealing drilling head 111 against drill pipe 112.

Primary seal 171 is located concentrically within a cylindrical cavity 175 located in the lower end of outer body 121. The lower end of elastomer 173 extends slightly below the lower end of outer body 121. A drilling head support 177 is connected into the string of drill pipe 112. Referring to FIG. 4, drilling head support 177 has a tubular body which is open on its upper end. A lower portion of drilling head support 177 has an axial bore 179 for the passage of fluids. Drill pipe 112 extends into drilling head support 177 and is secured to passage 179. Cavity 175 of outer housing 121 and drilling head support 177 may contain a latching mechanism 181, such as a J-slot mechanism, which releasably couples drilling head 11 to drilling head support 177 during handling at the surface and during running-in.

Diverter housing 113 has a lower end that releasably latches by latch 184 to an upper end of a subsea outer or low pressure wellhead housing 110. Diverter housing 113 has a central bore 185 into which drilling head 111 lands. Seals 186 on the exterior of outer body 121 sealingly engage bore 185. A guide funnel 188 extends upward from the sea floor and surrounds wellhead 113 and a lower portion of diverter housing 113. A diverter side outlet 183 extends laterally from diverter housing 113 and incorporates a choke 187 to control outflow of drilling returns. A relief valve 189 extends from diverter housing 113 and is designed to vent should an overpressure condition occur within diverter housing 113.

In operation, a large diameter conductor pipe will be installed, with wellhead 110 being at the upper end. Then drill string 112 is lowered from the drilling vessel through wellhead 110. Drill pipe support 177 will be secured into drill string 112 a selected distance from the bit. Drilling head 111 will be coupled to drill pipe support 177 with J-mechanisms 181. As drill string 112 is lowered further, outer body 121 will land and seal in diverter bore 185. Dogs 117 will be actuated to lock drilling head 111 to diverter housing 113. Drill string 112 is manipulated to disengage the J-mechanism 181, uncoupling drill string support 177 from drilling head 111. Drill string 112 is then lowered until the bit is on bottom and drilling will begin. By supplying hydraulic fluid pressure, gripper 151 is actuated to grip drill string 112, causing inner body 123 to grip drill pipe 112. As drill string 112 rotates, inner body 123 will rotate relative to outer body 121. Drilling fluid is pumped down drill string 112 and returns back up through wellhead housing 110 and into diverter housing 113. Because of seal 173, drilling fluid will flow out diverter side outlet 183. Choke 187 will create a desired back pressure in the drilling fluid contained in the annulus surrounding drill string 112.

When tool joints are lowered through seal 171, elastomer 173 flexes radially outward as the tool joint passes through it. As the tool joint exits seal 171, seal 171 contracts back to its original shape and seals around drill pipe 112.

Figure 6:
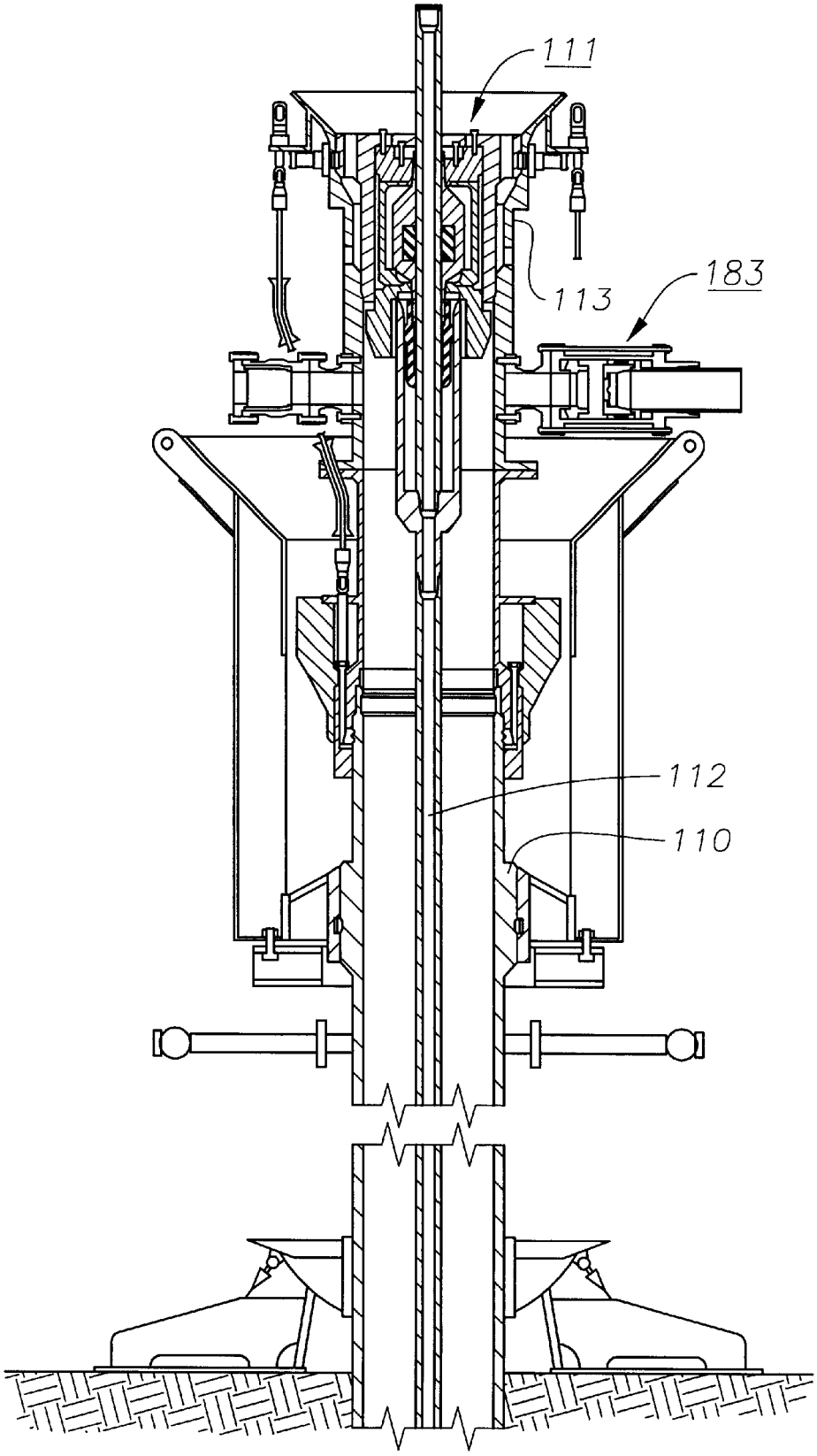
FIG. 6 is sectional side view of the drilling head of FIG. 4, shown with the drill string mandrel in abutment with the drilling head.
Figure 7:
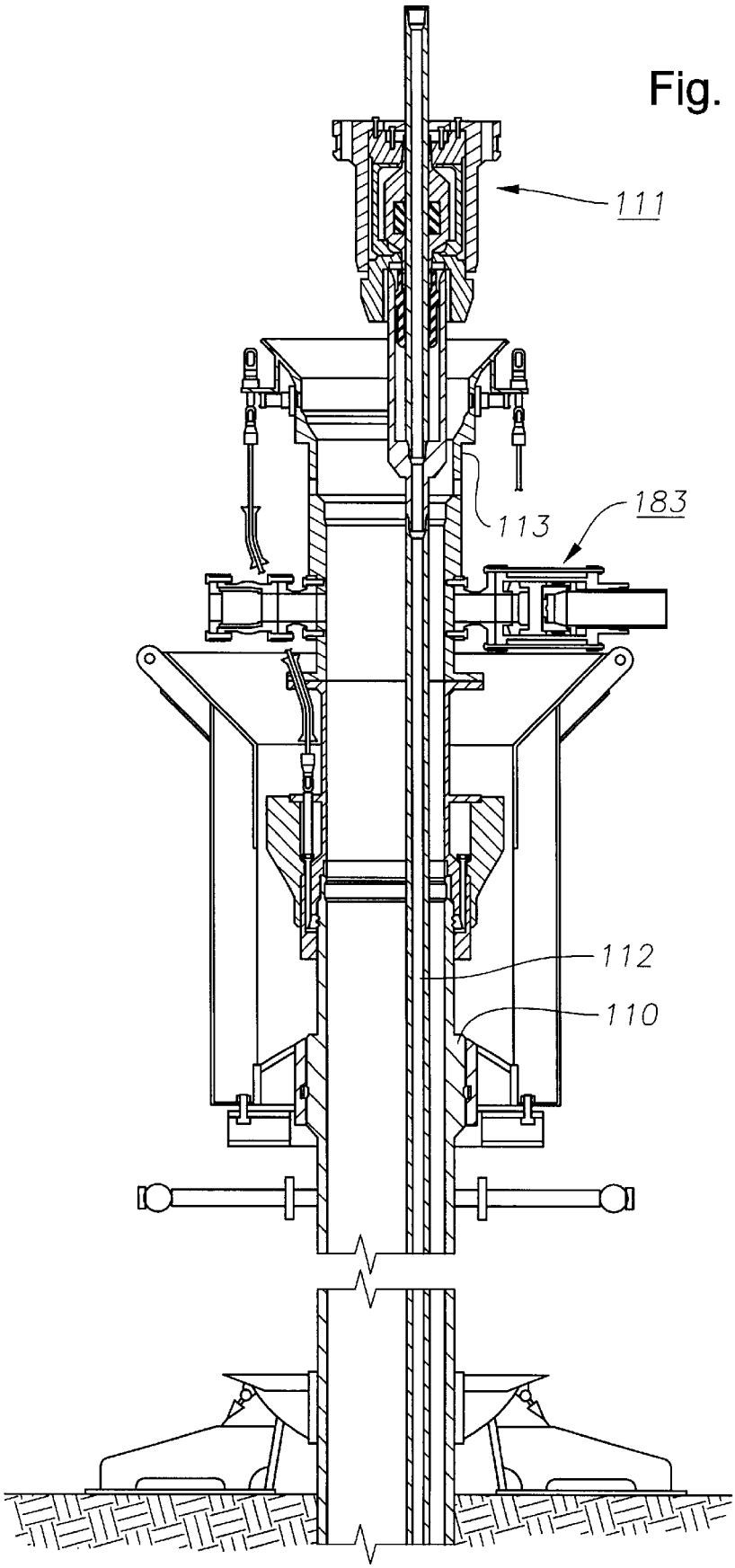
FIG. 7 is sectional side view of the drilling head of FIG. 4, shown during removal from the wellhead.

Referring now to FIGS. 6 and 7, drilling head 111 is designed to be easily removed from diverter housing 113. This operation is performed by lifting drill pipe 112 upward. As drill pipe 112 is raised, drilling head support 177 is also lifted upward toward drilling head 111 until it engages the lower end of drilling head 111 (FIG. 6). Dogs 117 are disengaged from outer housing 121 so that drilling head 111 can be lifted out of diverter housing 113 along with drill pipe 112 and drilling head support 177 (FIG. 6). There is no need to couple J-mechanisms 181 during retrieval. Drilling head 111 can be reinstalled by reversing these steps.

Once drilling is completed, a retrieval tool will engage diverter housing 113. With latches 184 released, diverter housing 113 will be retrieved. Then a string of casing will be run along with a high pressure wellhead housing located on the upper end. The high pressure wellhead housing will land in low pressure wellhead housing 110. A blowout preventer will be mounted to the high pressure wellhead housing. Drilling will continue.

The invention has numerous advantages. The system allows a positive pressure to be maintained on the drilling mud. This reduces the tendency for shallow formation to flow. The drilling head is readily installed and retrieved remotely.

Although the invention has been shown in only one of its forms, it should be apparent to those skilled in the art that it is not so limited, but is susceptible to various change without departing from the scope of the invention.

What is claimed is:

1. A subsea drilling assembly, comprising:

a housing adapted to be mounted to a subsea wellhead, the housing having a bore;

a drilling head adapted to be lowered from a drilling vessel and landed in the bore;

the drilling head having an inner body located within an outer body for rotating relative to the outer body;

at least one bearing located between the outer body and the inner body for facilitating rotation of the inner body relative to the outer body;

a seal connected to the inner body for sealingly engaging and rotating with an outer surface of a drill pipe;

an inner annulus located between the inner and outer bodies, the inner annulus containing a fluid;

a set of helical vanes on the inner body and located within the inner annulus, the vanes rotating with the inner body for circulating the fluid through the annulus to enhance cooling of the bearing; and an outlet from the bore of the housing for discharging drilling mud flowing upward around the drill pipe.

2. The subsea drilling assembly according to claim 1 further comprising an outer annulus in the outer body and surrounding the inner annulus, and wherein the vanes cause circulation between the inner and outer annuluses.

3. The subsea drilling assembly according to claim 1, further comprising:

a set of fins attached to an outer surface of the outer body for enhancing heat transfer from the outer body to a surrounding volume of seawater.

4. The subsea drilling assembly according to claim 1, further comprising:

an outer annulus in the outer body and surrounding the inner annulus, wherein the vanes cause circulation between the inner and outer annuluses; and a set of fins attached to an outer surface of the outer body for enhancing heat transfer from the outer body to a surrounding volume of seawater.

5. The subsea drilling assembly according to claim 1, wherein:

the set of helical vanes comprises an upper vane and a lower vane joining each other at a junction, the upper vane causing circulation of the fluid in an upward direction and the lower vane causing circulation in a lower direction.

6. The subsea drilling assembly according to claim 1, further comprising:

an outer annulus in the outer body surrounding the inner body, the outer annulus being supplied with the fluid;

a delivery port in the outer annulus that communicates the fluid in the outer annulus with the inner annulus, the delivery port being located intermediate upper and lower ends of the inner annulus;

an upper return port located at the upper end of the outer annulus and a lower return port located at the lower end of the outer annulus; and wherein the set of helical vanes comprises an upper vane and a lower vane joining each other at a junction located adjacent the delivery port, the upper vane causing circulation of the fluid in the inner annulus in an upward direction back into the outer annulus through the upper return port, and the lower vane causing circulation of the fluid in the inner annulus in lower direction back into the outer annulus through the lower return port.

7. The subsea drilling assembly according to claim 1, further comprising:

a hydraulically-energized gripper in the inner body for selectively gripping an outer surface of the drill pipe, the gripper being energized by the fluid contained within the inner annulus.

8. The subsea drilling assembly according to claim 1, further comprising:

a support adapted to be mounted to the drill pipe, the support being a tubular member having an inner surface adapted to be spaced from the drill pipe, defining an inner cavity; and a skirt extending from a lower portion of the outer body and surrounding at least a portion of the seal, defining an outer cavity between the seal and the skirt, so that the support while in a running-in position locates in the outer cavity and the seal locates within the inner cavity, the support being releasably attached to the skirt to allow the drill pipe to be lowered below the housing for drilling.

9. A subsea drilling assembly, comprising:

a housing adapted to be mounted to a subsea wellhead, the housing having a bore;

a drilling head adapted to be lowered from a drilling vessel and landed in the bore;

the drilling head having an inner body located within an outer body for rotation with a string of drill pipe relative to the outer body;

a seal mounted to a lower portion of the inner body for sealing around an outer surface of the drill pipe;

an outlet from a bore of the outer body for discharging drilling mud flowing upward around the drill pipe;

a support adapted to be mounted into the string of drill pipe, the support being a tubular member having an inner surface adapted to be spaced from the drill pipe, defining an inner cavity; and a skirt extending from a lower portion of the outer body and surrounding at least a portion of the seal, defining an outer cavity between the seal and the skirt, so that the support while in a running-in position locates in the outer cavity and the seal locates within the inner cavity, the support being releasably attached to the skirt to allow the drill pipe to be lowered below the housing for drilling.

10. The subsea drilling system according to claim 9, further comprising:

a J-slot mechanism located between the skirt and an outer surface of the support, the J-slot mechanism releasably attaching the drilling head to the support when the drilling head is in a running-in position.

11. The subsea drilling system according to claim 9, further comprising:

at least one bearing located between the outer body and the inner body for facilitating rotation of the inner body relative to the outer body;

an inner annulus located between the inner and outer bodies, the inner annulus containing a fluid that lubricates the bearing; and a set of helical vanes on the inner body and located within the inner annulus, the vanes rotating with the inner body for circulating the fluid throughout the annulus to enhance cooling of the bearing.

* * * * *